US009807515B2

(12) United States Patent
Ando

(10) Patent No.: US 9,807,515 B2
(45) **Date of Patent: *Oct. 31, 2017**

(54) PIEZOELECTRIC SPEAKER DEVICE

(71) Applicant: Murata Manufacturing Co., Ltd., Nagaokakyo-shi, Kyoto-fu (JP)

(72) Inventor: Masamichi Ando, Nagaokakyo (JP)

(73) Assignee: MURATA MANUFACTURING CO., LTD., Nagaokakyo-Shi, Kyoto-Fu (JP)

( * ) Notice: Subject to any disclaimer, the term of this patent is extended or adjusted under 35 U.S.C. 154(b) by 50 days.

This patent is subject to a terminal disclaimer.

(21) Appl. No.: 14/886,160

(22) Filed: Oct. 19, 2015

(65) Prior Publication Data

US 2016/0044421 A1 Feb. 11, 2016

Related U.S. Application Data

(63) Continuation of application No. 13/859,801, filed on Apr. 10, 2013, now Pat. No. 9,197,973, which is a (Continued)

(30) Foreign Application Priority Data

Oct. 15, 2010 (JP) ..... 2010-232158

(51) Int. Cl.
*H04R 29/00* (2006.01)
*H04R 17/00* (2006.01)
(Continued)

(52) U.S. Cl.
CPC ..... *H04R 17/005* (2013.01); *H04R 7/02* (2013.01); *H04R 17/00* (2013.01); *H04R 29/001* (2013.01);
(Continued)

(58) Field of Classification Search
None
See application file for complete search history.

(56) References Cited

U.S. PATENT DOCUMENTS 4,887,298 A * 12/1989 Haigler ..... H03G 3/301 330/207 P
8,000,483 B2 8/2011 de Haan et al.
(Continued)

FOREIGN PATENT DOCUMENTS

CN 101356852 A 1/2009
JP 2002-027592 A 1/2002
(Continued)

OTHER PUBLICATIONS

PCT/JP2011/072198 Written Opinion dated Oct. 17, 2011.

*Primary Examiner* — Curtis Kuntz
*Assistant Examiner* — Qin Zhu
(74) *Attorney, Agent, or Firm* — Arent Fox LLP

(57) ABSTRACT

A piezoelectric speaker device that includes an organic polymer piezoelectric film, at least one pair of electrodes provided in contact with the piezoelectric film and the at least one pair of electrodes including a user-side electrode on a first side of the piezoelectric film, an insulation layer on the user-side electrode, a flaw detection electrode line on the insulation layer, and a detection circuit configured to detect whether the flaw detection electrode line is in a normal electric conduction state.

17 Claims, 4 Drawing Sheets

Related U.S. Application Data continuation of application No. PCT/JP2011/072198, filed on Sep. 28, 2011.

(51) Int. Cl.
*H04R 17/02* (2006.01)
*H04R 7/02* (2006.01)

(52) U.S. Cl.
CPC .. *H04R 2307/023* (2013.01); *H04R 2307/025* (2013.01)

(56) References Cited

U.S. PATENT DOCUMENTS

| | | | | |
|---|---|---|---|---|
| 2002/0006208 | A1 | 1/2002 | Takei | |
| 2007/0189559 | A1 | 8/2007 | Haan et al. | |
| 2007/0262858 | A1* | 11/2007 | Smith | G08B 13/1672 340/507 |

FOREIGN PATENT DOCUMENTS

| | | | |
|---|---|---|---|
| JP | 2003-244792 | A | 8/2003 |
| JP | 2006-270663 | A | 10/2006 |
| JP | 2006-287480 | A | 10/2006 |
| JP | 2006-339834 | A | 12/2006 |
| JP | 2009-278377 | A | 11/2009 |

* cited by examiner

PIEZOELECTRIC SPEAKER DEVICE

CROSS REFERENCE TO RELATED APPLICATIONS

The present application is a continuation of application Ser. No. 13/859,801, filed Apr. 10, 2013, which is a continuation of International application No. PCT/JP2011/072198, filed Sep. 28, 2011, which claims priority to Japanese Patent Application No. 2010-232158, filed Oct. 15, 2010, the entire contents of each of which are incorporated herein by reference.

FIELD OF THE INVENTION

The present invention relates to a piezoelectric speaker device, more particularly to a piezoelectric speaker device including, as a driving power source, a piezoelectric film made of an organic polymer.

BACKGROUND OF THE INVENTION

For example, Japanese Unexamined Patent Publication No. 2003-244792 (Patent Document 1) describes a transparent piezoelectric speaker placed in a curved shape on a display of a cellular phone. The piezoelectric speaker includes a flexible piezoelectric film, transparent driving electrodes formed on the opposite surfaces of the piezoelectric film for applying a driving signal voltage thereto, and a protective film overlaid on the piezoelectric film. The Patent Document 1 describes an example where the piezoelectric film included in the piezoelectric speaker is constituted by a PVDF (polyvinylidene fluoride) film.

Organic polymers, such as PVDF described above, have relatively-smaller piezoelectric constants, which are only about 40 pC/N in cases of $d_{33}$. Therefore, in order to generate practical sound pressures, it is necessary to apply, thereto, voltages of several tens of volts to several hundreds of volts.

On the other hand, such a transparent piezoelectric speaker can attract user's interest due to its transparency and, as a result thereof, it has a greater opportunity of being touched by their hands and, has a higher possibility of being damaged at its surface due to their curiosity. Therefore, the aforementioned protective film may be damaged so that the driving electrode existing therebelow is exposed, which may result in situations which enable the driving voltage to be directly touched. In such cases, electric-shock accidents can be possibly induced, since a relatively-higher voltage is applied to the driving electrodes as described above.

Patent Document 1: Japanese Unexamined Patent Publication No. 2003-244792

SUMMARY OF THE INVENTION

Therefore, it is an object of the present invention to provide a piezoelectric speaker device capable of solving the above problems.

The present invention is directed to a piezoelectric speaker device including a speaker main body including a piezoelectric film made of an organic polymer, and at least one pair of driving electrodes provided in contact with the piezoelectric film for applying, to the piezoelectric film, a driving voltage for driving the piezoelectric film. The aforementioned driving electrodes include a user-side driving electrode provided on a side of the piezoelectric film which can be touched by a user's hand.

In order to solve the above technical problems, in the piezoelectric speaker device according to the present invention, the speaker main body further includes an insulation layer formed on the user-side driving electrode, and a flaw detection electrode line formed on the insulation layer. The speaker device further includes a detection circuit for detecting whether the flaw detection electrode line is in a normal electric conduction state, and driving-voltage control means for controlling the driving voltage applied to the driving electrodes, according to a result of detection by the detection circuit.

In the piezoelectric speaker device according to the present invention, preferably, the speaker main body further includes a protective layer formed on the insulation layer such that it is overlaid on the flaw detection electrode line.

Further, preferably, the piezoelectric speaker device according to the present invention further includes notification means for notifying a user of an occurrence of abnormality in the speaker main body, when the detection circuit has recognized damage in the flaw detection electrode line. As aspects of notification by the notification means, it is possible to exemplify displaying on a display, outputting of alert sounds, and the like.

Preferably, the flaw detection electrode line includes at least portions extending in two directions different from each other, on the insulation layer. Further, as examples of the flaw detection electrode line including such portions extending in two directions different from each other, it is possible to exemplify a flaw detection electrode line including portions extending in a meander shape, and a flaw detection electrode line including portions extending in a spiral shape.

Further, preferably, as the above flaw detection electrode line, there are provided a plurality of the flaw detection electrode lines which are electrically independent of each other.

When the detection circuit has recognized damage in the flaw detection electrode line, the above driving-voltage control means lowers the driving voltage applied to the driving electrodes, in order to reduce the risk of electric shocks. Preferably, it is adapted to lower the driving voltage to below 42.4 V. More preferably, it is adapted to set the driving voltage to 0 V.

With the present invention, even if the speaker main body is flawed at its surface by being touched by hands, it is possible to lower the driving voltage before the driving electrodes are exposed, which can prevent electric-shock accidents which can be induced by the user's touching the exposed driving electrodes. With the present invention, since the piezoelectric film included in the speaker main body is made of an organic polymer, the driving voltage applied to the piezoelectric film through the driving electrodes should be made to have a higher value in the range of several tens of volts to several hundreds of volts. Accordingly, the aforementioned prevention of electric-shock accidents has great significance.

In the piezoelectric speaker device according to the present invention, the speaker main body can further include the protective layer formed on the insulation layer, which can cause the protective layer not only to perform the function of protecting the flaw detection electrode line and the insulation layer, but also to perform the function of protecting the driving electrodes, thereby inhibiting the driving electrodes to be exposed. This can inhibit the occurrence of electric-shock accidents.

The piezoelectric speaker device according to the present invention can further include the notification means for notifying the user of the occurrence of abnormality, which enables certainly notifying the user of the occurrence of abnormality.

In the piezoelectric speaker device according to the present invention, the flaw detection electrode line can include at least portions extending in two directions different from each other. In this case, the flaw detection electrode line can be brought into a damaged state due to flaws in any direction out of the two directions different from each other, which enables improvement of the accuracy of the flaw detection, without increasing the flaw detection electrode line in number.

Further, as the above flaw detection electrode line, there can be provided a plurality of flaw detection electrode lines which are electrically independent of each other, which enables a control method which determines that a flaw has occurred, only when a predetermined number of flaw detection electrode lines are in a damaged state at the same time. This can prevent the flaw detection electrode lines from being immediately determined to have entered a failure mode, due to mere slight flaws which have no problem with functions, and due to mere partial breaks in the flaw detection electrode lines due to temporal changes thereof.

With the present invention, it is possible to sufficiently prevent electric-shock accidents, by lowering the driving voltage applied to the driving electrodes to below 42.4 V, when damage in the flaw detection electrode line has been recognized. This is because it has been specified that voltages of 42.4 V or more are hazardous to human bodies, in cases where the voltages are AC voltages. Further, it is possible to completely prevent electric-shock accidents, by setting the driving voltage applied to the driving electrodes to 0 V.

DETAILED DESCRIPTION OF THE INVENTION

For describing a piezoelectric speaker device according to a first embodiment of the present invention, at first, there will be described a speaker main body 2 included in the piezoelectric speaker device, with reference to FIG. 2 and FIG. 3.

Figure 1:
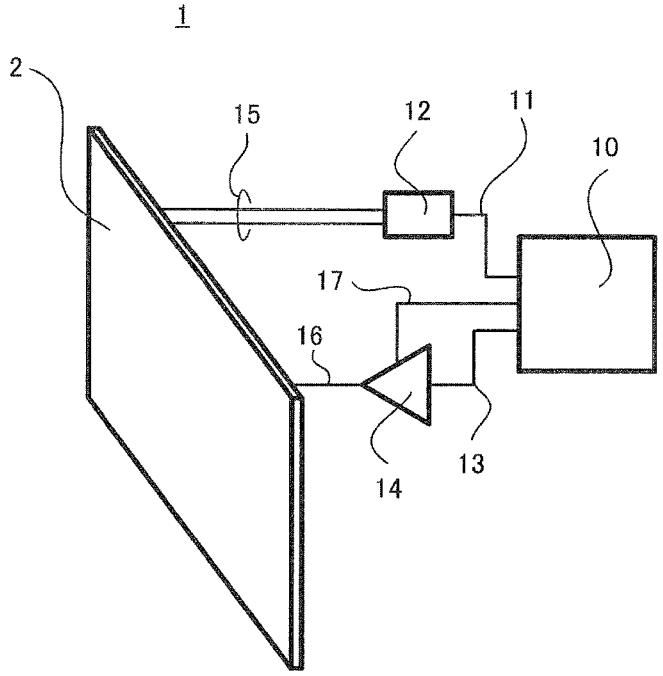
FIG. 1 is a block diagram illustrating a piezoelectric speaker device according to a first embodiment of the present invention.
Figure 2:
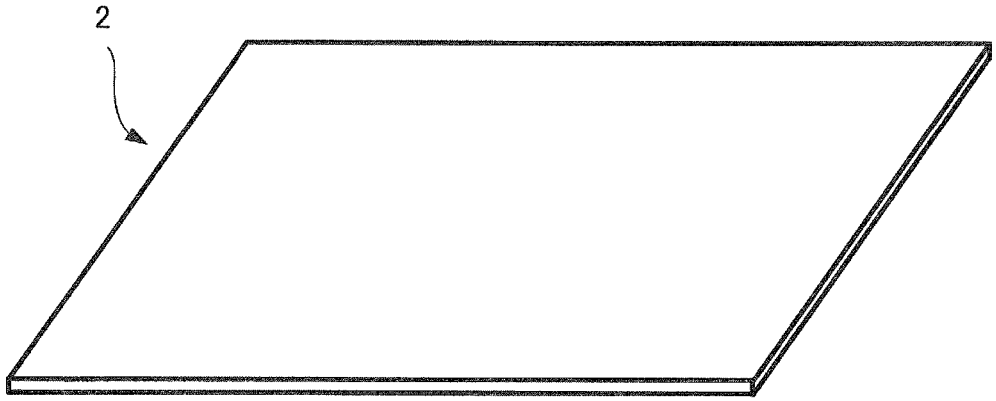
FIG. 2 is a perspective view illustrating the external appearance of a speaker main body included in the piezoelectric speaker device illustrated in FIG. 1.

The speaker main body 2 has a thin flat-plate shape as illustrated in FIG. 2 and has a thickness of about 0.2 to 1 mm in its entirety. When used, the speaker main body 2 can either be maintained at a flat surface as illustrated in FIG. 1 or be deformed into a curved shape as described in Patent Document 1.

Figure 3:
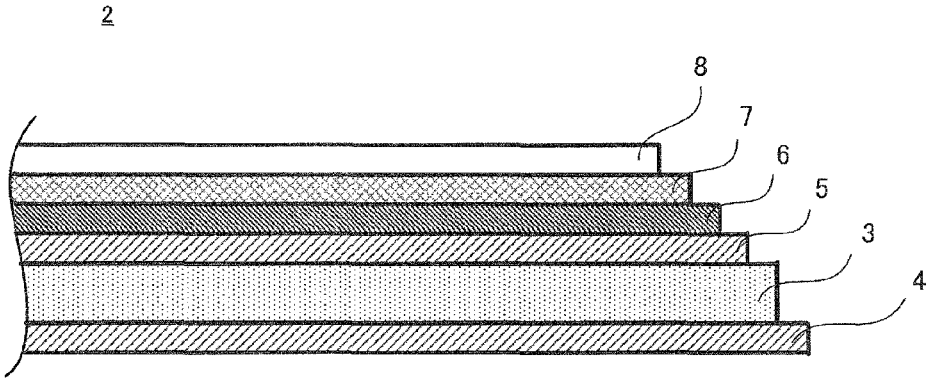
FIG. 3 is an enlarged view illustrating the cross-sectional structure of the speaker main body illustrated in FIG. 2.

The speaker main body 2 has a cross-sectional structure as illustrated in FIG. 3. Further, in FIG. 3, the thicknesses of respective components forming the speaker main body 2 are exaggeratedly illustrated.

The speaker main body 2 includes a piezoelectric film 3 made of an organic polymer. In this case, as such an organic polymer, it is possible to advantageously employ polyvinylidene fluoride (PVDF) or poly-L-lactic acid (PLLA), for example. The former, which is PVDF, is known to exhibit a relatively higher piezoelectric property, out of organic polymers which exhibit piezoelectric properties. The latter, which is PLLA, has the advantages of having excellent transparency, being carbon neutral, and having biodegradability.

On the respective main surfaces of the piezoelectric film 3, there are formed driving electrodes 4 and 5 for applying, thereto, a driving voltage for driving the piezoelectric film 3. In cases where the speaker main body 2 is required to have transparency, the driving electrodes 4 and 5 are made of inorganic-based materials such as indium tin oxide, indium-oxide-zinc-oxide or zinc oxide, or organic-based materials mainly composed of polythiophene or polyaniline. However, in cases where the speaker main body 2 is not particularly required to have transparency, the driving electrodes 4 and 5 can be made of metals, such as Ag, Au, Al, Cu or nickel.

The piezoelectric film 3 and the driving electrodes 4 and 5 constitute the oscillating portion of the piezoelectric speaker, and this oscillating portion can have either a structure including a plurality of laminated piezoelectric films or a bimorph structure including two laminated piezoelectric films adapted to perform expansion and contraction operations oppositely from each other, besides a three-layer structure as illustrated in FIG. 3.

Out of the above driving electrodes 4 and 5, the driving electrode 5 positioned in the upper side in FIG. 3 forms a user-side driving electrode provided on the side of the piezoelectric film 3 which can be touched by user's hands. On the user-side driving electrode 5, there is formed an insulation layer 6 having an electric insulation property. The insulation layer 6 is made of a resin having transparency and flexibility, in cases where the speaker main body 2 is required to have transparency. As the resin forming the insulation layer 6, it is possible to employ a resin having transparency, such as polyethylene terephthalate, polyethylene naphthalate, polymethylmethacrylate, polycarbonate, polypropylene, for example.

Flaw detection electrode lines 7 are formed on the insulation layer 6. The flaw detection electrode lines 7 can be also made of the same material as that of the above driving electrodes 4 and 5. In other words, in cases where the speaker main body 2 is required to have transparency, the flaw detection electrode lines 7 are made of inorganic-based materials such as indium tin oxide, indium-oxide-zinc-oxide or zinc oxide, or organic-based materials mainly composed of polythiophene or polyaniline. In cases where the speaker main body 2 is not particularly required to have transparency, the flaw detection electrode lines 7 can be made of metals, such as Ag, Au, Al, Cu or nickel.

The flaw detection electrode lines 7 will be described later, in detail, regarding its aspect, with reference to FIG. 4.

It is preferable that a protective layer 8 is formed on the insulation layer 6 such that it is overlaid on the flaw detection electrode lines 7. In cases where the speaker main body 2 is required to have transparency, the protective layer 8 is made of a resin having transparency, such as polyethylene terephthalate, polyethylene naphthalate, polymethylmethacrylate, polycarbonate, polypropylene, for example.

Further, in order to bond the above respective components to each other, an adhesive agent or the like is applied to boundaries required to be provided therewith, but such an adhesive agent is not illustrated in FIG. 3. However, in cases of applying thermocompression bonding and the like thereto for bonding the respective components to each other, there is no need for providing such an adhesive agent.

In cases where the speaker main body 2 is combined with a display device, such as a flat panel display, an organic EL display or an electronic paper, the display device is placed on the lower surface of the driving electrode 4 in the speaker main body 2 in FIG. 3.

FIG. 1 illustrates a block diagram of the speaker device 1 including the above speaker main body 2, and a circuit for driving and controlling it.

Referring to FIG. 1, a control IC 10 is connected to a detection circuit 12 through a signal line 11 and is connected to an amplifier 14 through a signal line 13. The detection circuit 12, which is for detecting whether the above flaw detection electrode lines 7 (see FIG. 3) are in a normal electric conduction state, is connected to the flaw detection electrode lines 7 through detection signal lines 15.

In driving the speaker main body 2, digital acoustic signals generated from a sound source are transmitted to the amplifier 14 through the signal line 13 to be amplified thereby, then, the amplified acoustic signals are transmitted, as driving voltages, to the driving electrodes 4 and 5 (see FIG. 3) through a signal line 16 and are applied to the piezoelectric film 3 (see FIG. 3) through the driving electrodes 4 and 5. The speaker main body 2 is driven in this way. A control line 17 is for controlling the output of the amplifier 14 according to control signals generated from the control IC 10.

Figure 4:
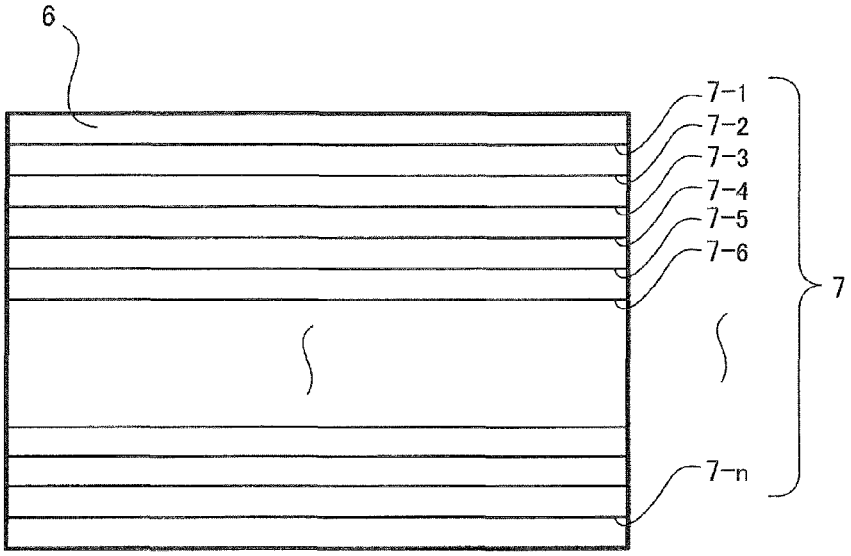
FIG. 4 is a plan view illustrating a distribution state of flaw detection electrode lines on an insulation layer illustrated in FIG. 3.

FIG. 4 illustrates a distribution state of the flaw detection electrode lines 7 on the insulation layer 6, which are viewed transparently through the protective layer 8. The flaw detection electrode lines 7 are constituted by n straight lines 7-1 to **7-*n***, which are extended in parallel with each other and placed at even intervals in a state where they are electrically independent of each other.

The respective lines 7-1 to **7-*n* are connected to the above detection signal lines 15 through a switching device (not illustrated) constituted by a transistor or the like and connected to the detection circuit 12 through the detection signal lines 15. In advance of driving the speaker main body 2 or at regular time intervals during the driving thereof, the control IC 10 drives the detection circuit 12 for detecting the presence or absence of flaws on the surface of the speaker main body 2**.

Figure 5:
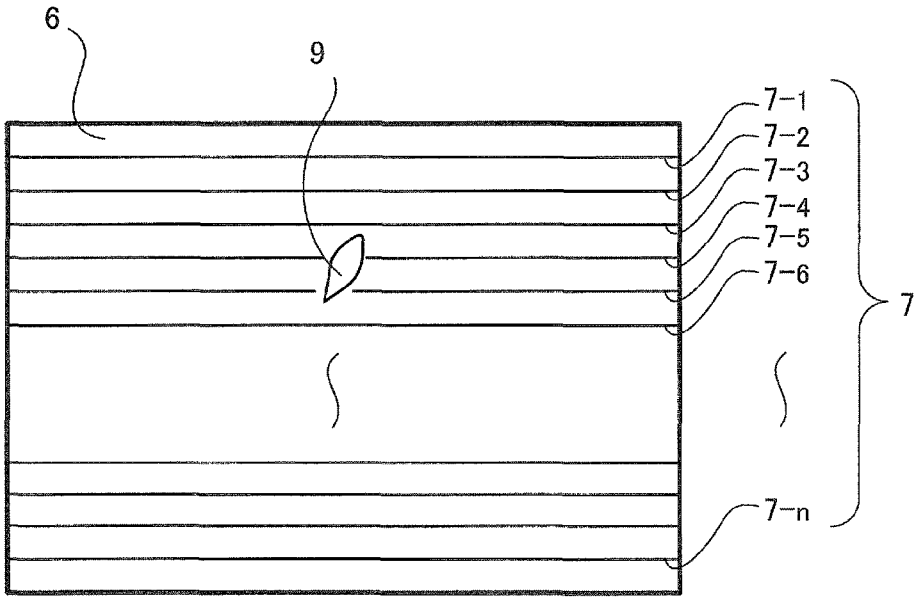
FIG. 5 is a view illustrating a state where the flaw detection electrode lines have been damaged due to the occurrence of a flaw in the speaker main body, corresponding to FIG. 4.

It is assumed that, due to an external force of some type, a flaw 9 has been induced in the speaker main body 2 as illustrated in FIG. 5, which has damaged the lines 7-5 and 7-6, for example, thereby inducing breaks or resistance increases therein. In this case, according to a determination criterion having been pre-set in the control IC 10, the detection circuit 12 detects the breaks or the resistance increases in the lines 7-5 and 7-6. In response thereto, the control IC 10 as driving-voltage control means controls the output of the amplifier 14 through the control line 17 to control the driving voltage applied to the driving electrodes 4 and 5 (see FIG. 3) in such a way as to lower it. In this case, in cases where it is an AC voltage, since the IEC standard specifies that voltages of 42.4 V or more are hazardous to human bodies, it is possible to sufficiently prevent electric-shock accidents, by lowering the driving voltage to below 42.4 V. Further, by setting the driving voltage to be 0 V, it is possible to completely prevent electric-shock accidents.

Further, in order to control the driving voltage, it is also possible to cut the signal outputted to the signal line 13 or to lower the source level, besides controlling the output of the amplifier 14 through the control line 17.

By providing abnormality notification means for notifying the user of the occurrence of abnormality in the speaker main body 2, in parallel with the above processing, it is possible to more certainly notify the user of the occurrence of abnormality. As aspects of notification by the abnormality notification means, it is possible to exemplify displaying on a display, outputting of alert sounds, and the like. More specifically, it is possible to display, on the display, a massage describing "the speaker has been broken, and the speaker driving voltage has been lowered in order to avoid hazards", and the like. In cases where the speaker device 1 is combined with a display device, signals can be transmitted from the control IC 10 to an IC for controlling images, in such a way as to realize displaying as described above on the display. In this case, the control IC 10 itself can be integrated with the IC for controlling images.

In cases where there are formed a large number of lines 7-1 to **7-*n* which form the flaw detection electrode lines 7 such that they are electrically independent of each other, as illustrated in FIG. 4, it is also possible to employ a control method which determines that a flaw has occurred, only when a predetermined number of lines, such as two or more lines, for example, have been damaged at the same time. With this control method, it is possible to prevent the flaw detection electrode lines 7 from being immediately determined to have entered a failure mode, due to mere slight flaws which have no problem with functions, and due to mere partial breaks in the flaw detection electrode lines 7** due to temporal changes thereof.

The flaw detection electrode lines can be formed in various aspects, as required. For example, FIG. 6 illustrates flaw detection electrode lines **7*a* constituted by a plurality of lines, such as four lines 7*a*-1 to 7*a*-4**, which have meander shapes and are electrically independent of each other.

Figure 6:
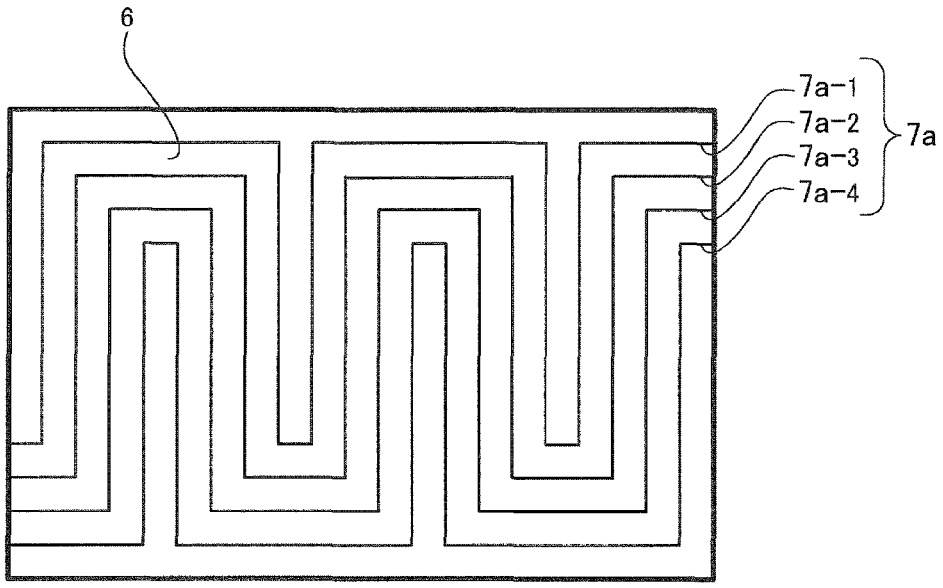
FIG. 6 is a view illustrating a second embodiment of the present invention, corresponding to FIG. 4.

In comparison with the flaw detection electrode lines 7 illustrated in FIG. 4, the flaw detection electrode lines **7*a* illustrated in FIG. 6 can have a reduced number of lines necessary for covering the same area. This enables further simplifying the circuit structure. Further, in the case of the flaw detection electrode lines 7 illustrated in FIG. 4, it may be hard to detect flaws induced in such a way as to extend in parallel with the direction of the extension of the lines 7-1 to 7-*n*. However, with the flaw detection electrode lines 7*a* illustrated in FIG. 6, each of the lines 7*a*-1 to 7*a*-4** has portions extending in two directions different from each other, which can improve the accuracy and the certainty of flaw detections, without increasing the number of lines or increasing the density of the line placement.

Further, the lines 7-1 to **7-*n* illustrated in FIG. 4 and the lines 7*a*-1 to 7*a*-4 illustrated in FIG. 6 are illustrated in a simplified manner, due to difficulties of the illustrations thereof. Actually, the lines 7-1 to 7-*n* and the lines 7*a*-1 to 7*a*-4 illustrated in FIG. 6** are placed more densely, and the respective line widths and the intervals between the respective lines are of the order of several hundreds of micrometers to several millimeters.

The shapes of the lines constituting the flaw detection electrode lines, and the number of these lines are not particularly limited. Regarding the shapes of the lines, there are possibly modification examples such as spiral shapes.

Figure 7:
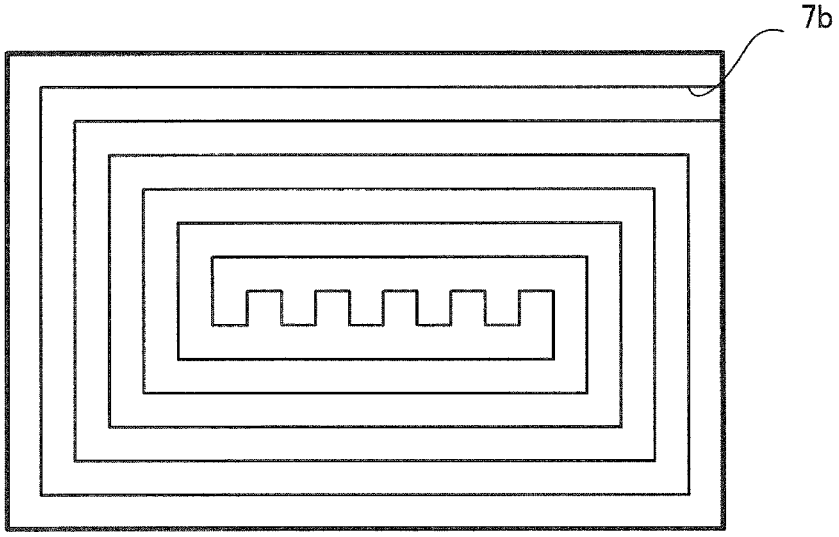
FIG. 7 is a view illustrating a third embodiment of the present invention, corresponding to FIG. 4.

FIG. 7 illustrates such a modification example. FIG. 7 illustrates a flaw detection electrode line 7*b* constituted by only a single line which partially has a meander shape and has a spiral shape in its entirety. In FIG. 7, similarly to in FIG. 6, it is illustrated in a simplified manner, due to difficulties of the illustration thereof. Further, in actual, the line 7*b* illustrated in FIG. 7 is placed more densely, and the respective line widths and the intervals between the respective lines are of the order of several hundreds of micrometers to several millimeters.

For example, as the flaw detection electrode line 7*b* illustrated in FIG. 7, depending on the shapes of the flaw detection electrode lines, they may be constituted by only a single line. In cases where the number of lines is one, there is no need for changing over among plural lines through a switching device such as a transistor for connecting them to the detection circuit 12, which enables significant simplification of the circuit structure.

DESCRIPTION OF REFERENCE SYMBOLS

1 Piezoelectric speaker device
2 Speaker main body
3 Piezoelectric film
4 Driving voltage
5 User-side driving voltage
6 Insulation layer
7, 7*a*, 7*b* Flaw detection electrode line
8 Protective layer
9 Flaw
10 Control IC
12 Detection circuit
14 Amplifier

The invention claimed is:

1. A piezoelectric device comprising:
an organic polymer piezoelectric film;
at least one pair of electrodes provided in contact with the piezoelectric film and the at least one pair of electrodes including a user-side electrode on a first side of the piezoelectric film;
an insulation layer on the user-side electrode;
a flaw detection electrode line on the insulation layer; and
a detection circuit configured to detect whether the flaw detection electrode line is in a normal electric conduction state.

2. The piezoelectric speaker device according to claim 1, further comprising a protective layer on the insulation layer and overlaying the flaw detection electrode line.

3. The piezoelectric speaker device according to claim 2, wherein the protective layer is made of a resin selected from the group consisting of polyethylene terephthalate, polyethylene naphthalate, polymethylmethacrylate, polycarbonate and polypropylene.

4. The piezoelectric speaker device according to claim 1, further comprising a notification circuit configured to notify a user when the detection circuit has recognized damage in the flaw detection electrode line.

5. The piezoelectric speaker device according to claim 1, wherein the flaw detection electrode line includes at least portions extending in two directions different from each other.

6. The piezoelectric speaker device according to claim 5, wherein the flaw detection electrode line includes a portion extending in a meander shape.

7. The piezoelectric speaker device according to claim 6, wherein the flaw detection electrode line includes a portion extending in a spiral shape.

8. The piezoelectric speaker device according to claim 5, wherein the flaw detection electrode line includes a portion extending in a spiral shape.

9. The piezoelectric speaker device according to claim 1, comprising a plurality of the flaw detection electrode lines which are electrically independent of each other.

10. The piezoelectric speaker device according to claim 1, further comprising:
a voltage control circuit configured to control a voltage applied to the at least one pair of electrodes based on a result of detection by the detection circuit.

11. The piezoelectric speaker device according to claim 10, wherein the voltage control circuit is adapted to lower the voltage applied to the electrodes to below 42.4 V when the detection circuit has recognized damage in the flaw detection electrode line.

12. The piezoelectric speaker device according to claim 10, wherein the voltage control circuit is adapted to set the voltage applied to the at least one pair of electrodes to 0 V when the detection circuit has recognized damage in the flaw detection electrode line.

13. The piezoelectric speaker device according to claim 1, wherein the piezoelectric film is polyvinylidene fluoride.

14. The piezoelectric speaker device according to claim 1, wherein the piezoelectric film is polylactic acid.

15. The piezoelectric speaker device according to claim 1, wherein the flaw detection electrode line is made of a material selected from the group consisting of indium tin oxide, indium-oxide-zinc-oxide, zinc oxide, polythiophene, polyaniline, Ag, Au, Al, Cu and nickel.

16. The piezoelectric speaker device according to claim 1, wherein the at least one pair of electrodes are made of material selected from the group consisting of indium tin oxide, indium-oxide-zinc-oxide, zinc oxide, polythiophene, polyaniline, Ag, Au, Al, Cu and nickel.

17. The piezoelectric speaker device according to claim 1, wherein the insulation layer is made of a resin selected from the group consisting of polyethylene terephthalate, polyethylene naphthalate, polymethylmethacrylate, polycarbonate and polypropylene.

* * * * *